United States Patent [19]

Mark

[11] 4,076,992

[45] Feb. 28, 1978

[54] VACUUM TUBE GRID STRUCTURES OF PHOSMIC BRONZE HAVING COPPER AND COPPER ALLOY CONICAL SUPPORTS

[75] Inventor: John Thomas Mark, Millersville, Pa.

[73] Assignee: RCA Corporation, New York, N.Y.

[21] Appl. No.: 698,368

[22] Filed: Jun. 22, 1976

[51] Int. Cl.[2] ..... H01J 1/46; H01J 21/10

[52] U.S. Cl. ..... 313/296; 313/299; 313/311; 313/348

[58] Field of Search ..... 313/296, 299, 311, 348

[56] References Cited

U.S. PATENT DOCUMENTS

| | | | |
|---|---|---|---|
| 2,939,988 | 6/1960 | Culbertson et al. | 313/299 X |
| 3,164,740 | 1/1965 | Moscony et al. | 313/348 |
| 3,337,933 | 8/1967 | Seiffarth et al. | 313/299 X |
| 3,719,856 | 3/1973 | Koppius | 313/311 |
| 3,784,866 | 1/1974 | Manyafov et al. | 313/299 |
| 3,826,948 | 7/1974 | Polese et al. | 313/299 |

OTHER PUBLICATIONS

"Material and Techniques for Electon Tubes", by Walter H. Kohl, General Telephone & Electronics Technical Series, 1960 TK6565, V3K65, pp. 211-212.

*Primary Examiner*—Saxfield Chatmon, Jr.
*Attorney, Agent, or Firm*—Glenn H. Bruestle; George E. Haas

[57] ABSTRACT

A vacuum tube includes a cylindrical cathode around which a frusto-conical control grid extends. The control grid, which is made out of Phosnic bronze, has its larger diameter end attached to the smaller end of a first hollow truncated copper cone. A cylindrical Phosnic bronze screen grid extends coaxially around the control grid. One end of the screen grid is attached to the smaller diameter end of a second hollow truncated cone. The second cone extends around the first cone and is made out of a copper clad alloy of cobalt, nickel and iron. An anode encircles the screen grid.

7 Claims, 1 Drawing Figure

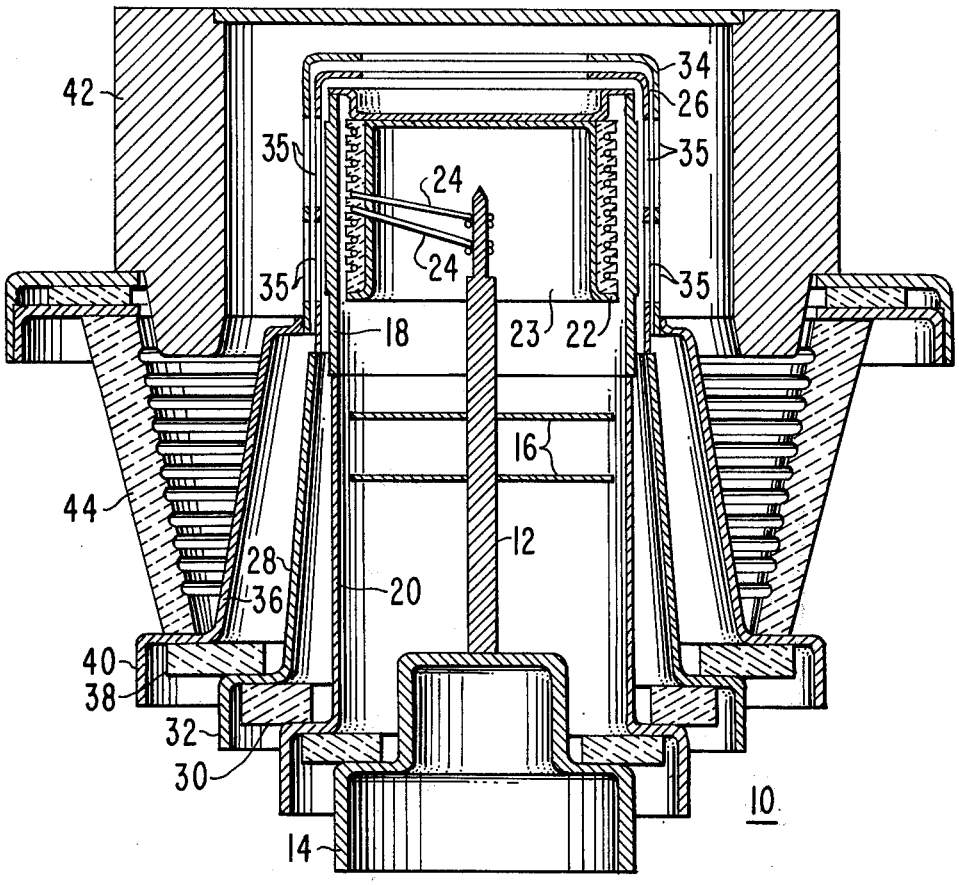
42
34
26
35
35
24
24
35
35
18
23
22
16
44
12
28
36
20
40
38
32
30
14
10

VACUUM TUBE GRID STRUCTURES OF PHOSMIC BRONZE HAVING COPPER AND COPPER ALLOY CONICAL SUPPORTS

BACKGROUND OF THE INVENTION

The present invention is related to vacuum tubes and more particularly to vacuum tube grid structures.

Conventional high power vacuum tubes often use a tungsten matrix cathode which usually takes the form of a porous tungsten cylinder filled with barium oxide, aluminum oxide and calcium oxide. Although this type of cathode has many advantages, under some circumstances the cathode tends to emit a considerable amount of barium and barium oxide which becomes deposited on the tube grids. Only the deposited barium oxide remains on the grids causing them to emit electrons thus rendering the tube unusable. To solve the problem of the grid emission, a variety of coatings such as titanium and zirconium have been applied to the grids in an effort to reduce or eliminate the electron emission. However, these relatively short life coatings have met with little success.

SUMMARY OF THE INVENTION

A vacuum tube with a cylindrical cathode has a frusto-conical Phosnic bronze control grid extending coaxially around the cathode. The larger end of the control grid is attached to the smaller end of a hollow truncated cone made out of copper. A cylindrical, Phosnic bronze screen grid extends coaxially around the control grid. One end of the screen grid is attached to the smaller end of another hollow truncated cone. The second cone is made of a copper clad cobalt-nickel-iron alloy and extends around the first cone. The anode of the tube extends around the screen grid.

BRIEF DESCRIPTION OF THE DRAWINGS

The FIGURE is a cross-sectional view of a vacuum tube employing the present grid structure.

DETAILED DESCRIPTION OF THE INVENTION

A high powered vacuum tube generally designated as 10, has cylindrical shape. At the center of the cylinder extending from a terminal 14 is a post 12 which supports two getter discs 16 of zirconium, for example. Extending coaxially around the post 12 is a tungsten matrix cathode 18 mounted on a support cylinder 20. The tungsten-matrix cathode is a porous tungsten cylinder filled with barium oxide, aluminum oxide and calcium oxide in molar ratios of 5:3:2 or 4:1:1. Extending from the top of the cathode 18 between the post 12 and the cathode is a tubular heater support 22. The heater support 22 is formed of an electrically insulated material and has a plurality of grooves in its periphery. Two heater wires 24 are wrapped around the heater support 22 in the peripheral grooves. One end of each of the heater wires is wrapped around the post 12 and the other end is electrically connected to the cathode 18. The heater support 22 is supported by a tantalum cylinder 23 which also serves as a getter. A control grid 26 made out of Phosnic bronze (Trademark) extends coaxially around the cathode 22 and is spaced therefrom. Phosnic bronze is an alloy consisting of 98.65% copper, 1.1% nickel, and 0.25% phosphorus. The control grid 26 is in the shape of a hollow frustrum of a cone with its smaller diameter end near the top of the tube. The larger end of the control grid 26 is attached to the small end of a first hollow truncated cone 28 which is made out of copper. The larger end of the first cone 28 is attached to the cathode support cylinder 20 by a ceramic ring 30 and includes an external control grid terminal 32.

A cylindrical Phosnic bronze screen grid 34 is coaxially around the control grid 26 and is spaced therefrom. Both the control grid 26 and the screen grid 34 have a plurality of apertures 35 extending through their cylindrical surfaces. These apertures 35 in each grid 26 and 34 are aligned to form openings through which electrons flow from the cathode 18. The lower end of the screen grid 34 is attached to a second truncated hollow cone 36 at its smaller diameter end. The second cone 36, which extends around the first cone 28, may be made of a copper clad alloy of cobalt-nickel and iron, such as Kovar (Trademark). The inner and outer surfaces of the second cone 36 are coated with copper so that the coatings each comprise ten percent of the cone's thickness. The larger end of the second cone 36 is attached to the first cone 28 by another ceramic ring 38 and includes an external screen grid terminal 40. Extending coaxially around the screen grid 34 is an anode 42 which is supported from the second cone 36 by an inverted hollow truncated cone 44 of a ceramic material.

Although the basic structure of the tube 10 appears fairly conventional, several critical improvements have been incorporated to reduce or eliminate the grid emission. A closely toleranced grid spacing and grid thickness ratio has been found to produce a reduction. For a cathode having an outer diameter of about 1.40 inches (35.56 mm), the control grid should be approximately 15 mils (381 microns) from the cathode and the spacing between the two grids should also be about 15 mils (381 microns). The thickness of the two grids has also been found to be critical. In this tube the control grid should be 18–20 mils (about 457–508 microns) thick while the screen grid has a thickness of 27–31 mils (about 686 to 787 microns). The support cones 28 and 36 are substantially the same thickness, 30 mils (762 microns) for example. Although the overall diameter and the cathode diameter of the tube generally increases and decreases with corresponding increases and decreases in the cathode area and tube power, the spacings of the tube elements should remain about the same. The thickness of the two grids, however, may vary so long as a control grid to screen grid thickness ratio of about 2:3 and equal cone thickness is maintained. This criticality of grid spacing and thickness aids in maintaining the temperature of both grids essentially the same and below 400° C which is the minimum temperature for grid emission due to the barium oxide. The 2:3 ratio is unique in providing thermal equality and enhancement of tube performance. The ratio increases the $\mu_2$ of the tube and improves the constant current characteristic according to the equation:

$$I_B = G\left(\mathrm{Ec}_1 + \frac{Ec_2}{\mu_1} + \frac{E_B}{\mu_2}\right)^{3/2}$$

where; $\mathrm{Ec}_1$ is the control grid voltage, $\mathrm{Ec}_2$ is the screen grid voltage, G is the perveance, $I_B$ is the plate current and $E_B$ is the plate voltage, $\mu_1$ is the change in $\mathrm{Ec}_2$ divided by the change in $\mathrm{Ec}_1$ for constant $I_B$, and $\mu_2$ is the change in $E_B$ divided by the change in $\mathrm{Ec}_1$ with $I_B$ constant. The thickness ratio of 2:3 raises the value of $\mu_2$ thereby reducing the effect of changes in $E_B$ and making $I_B$ more constant at various values of $E_B$.

The present vacuum tube 10 offers several advantages over conventional tube design, which aid in the elimination of grid electron emission and grid misalignment due to expansion. The problems of grid misalignment due to expansion are overcome through the use of a conical control grid and a specific material combination for the grids and their support cones. The tapered control grid has its smaller end near the top of the tube where the operating temperature is higher. Under operating conditions the upper end of the control grid expands more than the other end so that the conical taper is eliminated resulting in the outer diameter of the control grid being equidistantly spaced from the screen grid. The use of Phosnic bronze for the grid materials and copper the first cone and copper clad Kovar (Trademark) for the second cone equalizes the upward expansion of the two grids and their supports so that the apertures in each grid remain aligned under the operating temperatures of the device. The combination of grid and cone materials as well as their dimensions has lowered and equalized the grid temperature and eliminated electron emission. The tube also has improved constant current characteristics due to the 2:3 grid thickness ratio.

I claim:

1. A vacuum tube comprising:

a cylindrical cathode;

a frusto-conical Phosnic bronze control grid extending coaxially around the cathode;

a first hollow truncated cone having it smaller diameter end attached to the larger diameter end of the control grid, the first cone being made of a copper;

a cylindrical Phosnic bronze screen grid extending coaxially around the control grid;

a second hollow truncated cone having its smaller diameter end attached to one end of the screen grid and extending around the first cone, the second cone being made of a copper clad alloy of cobalt, nickel and iron; and an anode extending around the screen grid.

2. The vacuum tube as in claim 1 wherein the cylindrical cathode comprises a tungsten matrix formed of a porous tungsten cylinder filled with barium oxide, aluminum oxide and calcium oxide in molar ratios selected from the group consisting of 5:3:2 and 4:1:1.

3. The device as in claim 1 wherein the first cone has an inner and an outer copper cladding each comprising approximately 10% of the cone's thickness.

4. The tube as in claim 1 wherein the first and second cones are of substantially equal thickness.

5. The tube as in claim 1 wherein the thickness ratio of the control grid to the screen grid is about 2:3.

6. The tube as in claim 5 wherein the thickness of the control grid is between 18 and 20 mils (about 457 and 508 microns) and the thickness of the screen grid is between 27 and 31 mils (about 686 and 787 microns).

7. The tube as in claim 6 wherein the spacing between the control grid and the cathode and the screen grid and the control grid is equal to approximately 15 mils (approximately 381 microns).

* * * * *

UNITED STATES PATENT OFFICE
CERTIFICATE OF CORRECTION

PATENT NO. : 4,076,992

DATED : February 28, 1978

INVENTOR(S) : John Thomas Mark

It is certified that error appears in the above-identified patent and that said Letters Patent are hereby corrected as shown below:

In the Title: "Phosmic" should be --Phosnic--.

Column 1, Line 45 after "has" insert --a--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*